United States Patent [19]

Munro

[11] 4,380,218

[45] Apr. 19, 1983

[54] STARTING AID FOR INTERNAL COMBUSTION ENGINES

[75] Inventor: Malcolm W. Munro, London, England

[73] Assignee: Lucas Industries Limited, Birmingham, England

[21] Appl. No.: 261,474

[22] Filed: May 7, 1981

[30] Foreign Application Priority Data

Jul. 2, 1980 [GB] United Kingdom ..... 8021633

[51] Int. Cl.[3] ..... F02N 17/00

[52] U.S. Cl. ..... 123/179 H; 123/556; 123/180 R; 431/208

[58] Field of Search ..... 123/145 A, 179 H, 179 G, 123/180 R, 556, 557, 558, 549, 550; 431/208, 259, 260, 263, 264

[56] References Cited

U.S. PATENT DOCUMENTS

| | | | |
|---|---|---|---|
| 2,841,214 | 7/1958 | Ridel et al. | 431/208 |
| 3,091,282 | 5/1963 | Curzon | 123/180 R |
| 3,400,699 | 9/1968 | Van Kirk et al. | 123/179 H |
| 3,689,195 | 9/1972 | Beesch et al. | 123/179 H |
| 3,762,378 | 10/1973 | Bitonti | 123/557 |
| 3,978,836 | 9/1976 | Noguchi et al. | 123/179 H |
| 4,202,302 | 5/1980 | Skinner | 123/179 H |

FOREIGN PATENT DOCUMENTS

| | | | |
|---|---|---|---|
| 1207147 | 12/1965 | Fed. Rep. of Germany | 123/179 H |
| 1208551 | 1/1966 | Fed. Rep. of Germany | 123/179 H |
| 2030214 | 4/1980 | United Kingdom | 123/179 H |

*Primary Examiner*—Parshotam S. Lall

[57] ABSTRACT

A starting aid for an internal combustion engine includes a tubular body about which is located a stack of electrically insulating and heat resisting rings. Wound on the rings is a heating element and in the wall of the tubular body is an aperture through which fuel can flow. The fuel flows along the gaps defined between the rings to the heating element and is vaporized and subsequently ignited.

9 Claims, 2 Drawing Figures

STARTING AID FOR INTERNAL COMBUSTION ENGINES

This invention relates to starting aids for assisting the starting of internal combustion engines and of the kind which are located in the air inlet manifold of the engine and to which liquid fuel is supplied, the fuel being vapourised and ignited so that a flame is produced which heats the air flowing to the engine.

A starting aid of this type is disclosed in the specification of British Pat. No. 1,001,311 and it comprises a tubular body which at one end is connected to a fuel supply and from the other end of which emerges when the aid is in use, a stream of vapourised fuel. This is mixed with air within a tubular shield and ignited. A temperature responsive valve is provided within the aforesaid body and which opens to allow fuel flow only when an electric heating element surrounding the body, has heated the body a sufficient amount to guarantee vapourisation of the fuel. The aid described does require an appreciable time to become operative and it is therefore the usual practice to energise the starting aid a few seconds before the engine is cranked for starting purposes.

The delay in the aid becoming operative is due to the need to heat the body to a temperature at which it will vapourise the fuel and whilst the thermal mass of the body can be reduced, this often results in the body being weak from the mechanical aspect so that it cannot withstand the vibration to which it is subject when the aid is mounted on an engine.

The object of the invention is to provide a starting aid of the kind set forth in which the time required for the aid to become operative is significantly reduced.

According to the invention a starting aid of the kind specified comprises a tubular body which is closed at one end, a fuel inlet to the other end of the body, a stack of electrically insulating rings mounted about the body, said rings being formed from a material which can withstand high temperature, an electrical heating element wound about said rings, an aperture in the wall of said body and through which fuel can flow to the peripheral surfaces of said rings by way of the gaps therebetween, said element acting to vapourise the fuel and means for igniting the vapourised fuel.

An example of a starting aid in accordance with the invention will now be described with reference to the accompanying drawings in which.

Figure 1:
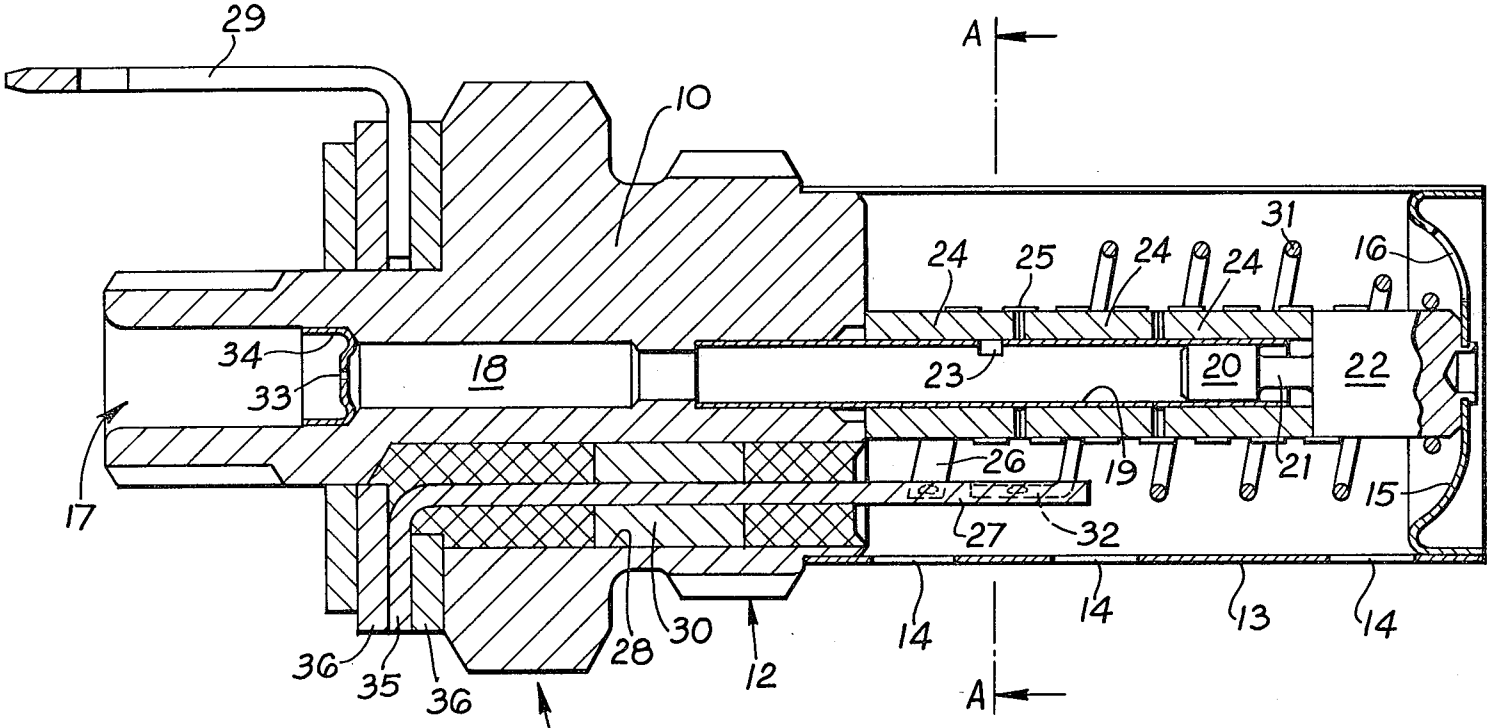
FIG. 1 is a sectional side elevation of the aid.
Figure 2:
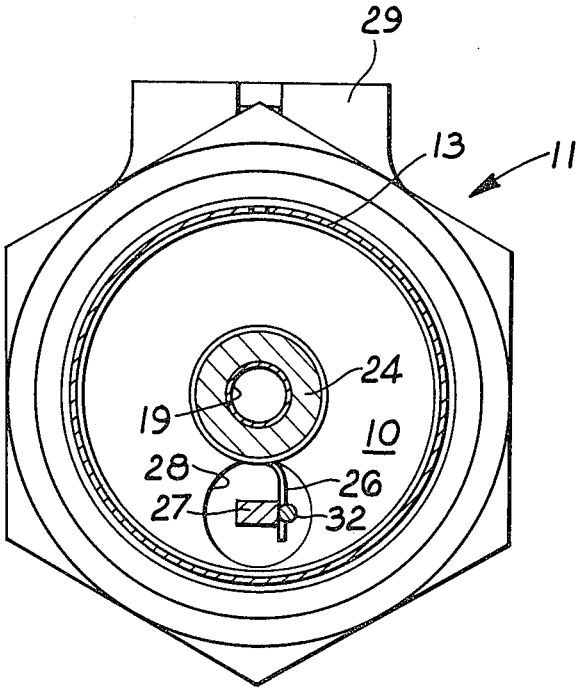
FIG. 2 is a section on the line AA of FIG. 1.

Referring to the drawings, the starting aid comprises a main body 10 having a portion 11 of hexagonal shape and a peripherally screw threaded portion 12 which in use, is screwed into a complementarily threaded boss on the inlet manifold of the engine. Mounted on the body 10 is a split tubular shroud 13 which is formed from thin sheet material and which is provided with apertures 14 through which in use, air being drawn along the inlet manifold of the engine can flow to the zone defined within the shroud. The open end of the shroud 13 is closed by a closure plate 15 which is of dished form and is provided with an aperture 16.

The end of the main body remote from the shroud defines a fuel inlet generally indicated at 17. The fuel inlet communicates with a passage 18 in the main body and secured within the end portion of the passage remote from the inlet is a tubular body 19. The tubular body 19 is formed from metal and its end remote from the body 10 is closed by a cylindrical metallic plug 20. The plug 20 is carried by and is integral with a reduced extension 21 of a locating member 22 which is secured to the closure plate 15.

Formed in the tubular body 19 is at least one aperture 23. Moreover, surrounding the tube are a plurality of rings 24 which are formed from electrically insulating material which is also resistant to heat. Conveniently the rings 24 are formed from a ceramic material. The rings form a stack one end of the stack bearing against the body 10 whilst the other end of the stack bears against the locating member 22. Wound about the stack of rings is a helical heating element 25 one end of which is secured to the locating member 22. The heating element is formed from metal tape. As mentioned, one end of the tape is secured to the locating member 22 whilst the other end of the tape indicated at 26, is electrically connected to a conductor member 27 which is supported in electrically insulating relationship within a bore 28 formed in the body. The conductor member is integrally formed with a terminal connector 29 which in use, is connected to one terminal of a source of electric current, the other terminal of which is connected to the body 10. The conductor member 27 is located in the bore 28 by means of an insulating plug 30 and the spaces at the opposite ends of the plug are filled with a suitable heat resistant and electrically insulating sealant. The connector and conductor member are integral with a plate 35 which is insulated by washers 36 from the body 10.

Located in the space defined by the shroud 13 is a helically wound ignition element generally indicated at 31. One end of this element is secured to the locating member 22 whilst the other end of the element is secured to the conductor member 27. It will be noted that the ignition element is formed from wire and that the end portion 32 is bent so that it lies substantially parallel to the conductor member 27. The ends of the elements are conveniently resistance welded to the conductor member and the closure plate and the shroud is welded in a similar fashion to the body 10.

The flow of fuel to the inlet 17 is conveniently controlled by an electromagnetic valve which is energised when the aid is required to be used. The current flowing in the two elements 25 and 31 may be controlled by an electrical control circuit which acts to ensure that under all operating conditions, the voltage applied to the elements is correct.

In operation, when the electromagnetic valve is opened and the elements energised, fuel flows through the aperture 23 and to the outer surfaces of the rings 24. This flow of fuel takes place along the small gaps defined between adjacent rings. As the fuel comes into contact with the heating element 25, it is vapourised and the vapourised fuel is ignited by the element 31. With this arrangement the fuel impinges directly upon the heating element and therefore the aid is operative as soon as the heating element has reached its operating temperature. The heating element is of course designed so that it reaches its operating temperature quickly and therefore the aid is effective very soon after electric power is supplied to the valve and the elements. It has been found that it is possible to energise the starting aid at the same time as the starting motor of the engine and that the aid will be effective to start the engine almost as soon as the starting motor has started to crank the engine.

In the arrangement shown in FIG. 1, the electromagnetic valve is disposed at some remote point to the starting aid. The valve however can be associated with the starting aid. It is necessary to carefully control the rate of fuel flow through the aperture or apertures 23 and for this purpose an orifice 33 is provided in an orifice plate 34 which is located in the inlet 17. In addition the pressure at the inlet 17 may be controlled by a regulating valve (not shown) which may be designed so that the air pressure in the inlet manifold of the engine is taken into account. In this case it is advantageous to have the regulating valve located in an enlarged body of the starting aid.

The rings 24 as shown are provided with grooves in their end faces through which fuel can flow to the exterior surfaces of the rings. An alternative arrangement is to mount the rings so that they are axially loose on the member 19.

I claim:

1. A starting aid for assisting the starting of an internal combustion engine and of the kind which is located in the air inlet manifold of the engine and to which liquid fuel is supplied, the fuel being vapourised and ignited so that a flame is produced which heats the air flowing to the engine, the aid comprising a tubular body which is closed at one end, a fuel inlet to the other end of the body, a stack of electrically insulating rings mounted about the body defining narrow gaps therebetween, said rings being formed from a material which can withstand high temperature, an electrical heating element wound about said rings, an aperture in the wall of said body and through which fuel can flow to the peripheral surfaces of said rings by way of the gaps therebetween, said element acting to vapourise the fuel and means for igniting the vapourised fuel.

2. A starting aid according to claim 1 in which said one end of the tubular body is closed by a plug.

3. A starting aid according to claim 2 including an apertured shroud surrounding said tubular body in spaced relationship, the end of said shroud adjacent said one end of the tubular body being closed by a closure plate, said plug being formed integrally with a locating member carried by said closure plate, said locating member acting to locate one end of said stack of rings.

4. A starting aid according to claim 3 in which said tubular body and said shroud are carried by a main body which is adapted to be retained on the inlet manifold of the engine.

5. A starting aid according to claim 4 in which the means for igniting the vapourised fuel comprises an ignition element located in the space defined between the tubular body and the shroud.

6. A starting aid according to claim 5 in which said heating element and said ignition element are of helical form, said elements at said one end of the tubular body being secured to said locating member, the other ends of said elements being secured to a conductor member which extends in electrically insulating relationship through a bore formed in said main body.

7. A starting aid according to claim 6 including an insulating bush in said bore.

8. A starting aid according to claim 4 including a fuel passage in said main body, said fuel passage communicating with the interior of the tubular body and connecting with a fuel inlet in said main body.

9. A starting aid according to claim 8 including an orifice plate in said fuel inlet, said orifice plate having an orifice through which the fuel flows from the inlet to the tubular body.

* * * * *